US007784415B2

(12) United States Patent
Engel

(10) Patent No.: US 7,784,415 B2
(45) Date of Patent: Aug. 31, 2010

(54) SOLID FUEL BURNER-GASIFIER METHODS AND APPARATUS

(75) Inventor: Thomas Wolfgang Engel, East Hampton, CT (US)

(73) Assignee: Thomas W. F. Engel, East Hampton, CT (US)

( * ) Notice: Subject to any disclaimer, the term of this patent is extended or adjusted under 35 U.S.C. 154(b) by 896 days.

(21) Appl. No.: 11/383,230

(22) Filed: May 15, 2006

(65) Prior Publication Data

US 2007/0261616 A1 Nov. 15, 2007

(51) Int. Cl.
*F23K 3/00* (2006.01)

(52) U.S. Cl. ..... 110/229; 110/101 R; 110/110; 110/115

(58) Field of Classification Search ..... 110/218, 110/226, 227, 228, 229, 230, 101 R, 110, 110/115, 329, 327; 266/178; 48/66
See application file for complete search history.

(56) References Cited

U.S. PATENT DOCUMENTS 475,329 A * 5/1892 Loughran ..... 110/218
4,385,566 A * 5/1983 Harris ..... 110/110
4,452,153 A * 6/1984 Deneau ..... 110/247
4,608,059 A * 8/1986 Kupfer et al. ..... 48/66
4,732,092 A * 3/1988 Gould ..... 110/229
5,089,030 A * 2/1992 Michel-Kim ..... 48/66
5,390,630 A * 2/1995 Virr ..... 110/229
6,254,665 B1 * 7/2001 Matsushita et al. ..... 75/484
6,368,104 B1 * 4/2002 Saxena et al. ..... 432/138
6,959,654 B2 * 11/2005 Abrams ..... 110/345
2003/0089288 A1 * 5/2003 Abrams ..... 110/233

* cited by examiner

*Primary Examiner*—Kenneth B Rinehart
*Assistant Examiner*—David J Laux
(74) *Attorney, Agent, or Firm*—Matt Paterson

(57) ABSTRACT

A method and apparatus for delivery of a solid particulate fuel to a heating system. The present invention provides a lock-up transport system to deliver particles of solid fuel in a downstream direction while maintaining the position of the particles relative to each other. The lock-up transport system provides a linear mass flow through the gasification stages of the fuel.

4 Claims, 5 Drawing Sheets

SOLID FUEL BURNER-GASIFIER METHODS AND APPARATUS

BACKGROUND OF THE INVENTION

1. Field of the Invention

Embodiments of the present invention relate to gasifiers and combusters in general and to apparatus and methods related to the controlled fuel feed and combustion of various solid fuels, including biomass fuels, in particular.

2. Description of the Related Art

In smaller-scale heating systems characterized by relative simplicity there are two primary methods employed to deliver solid fuel to the burner. These are well known in the art and are referred to as bottom feed (or fed) and top feed (or fed). Bottom fed heating systems in the prior art convey solid fuel into the burner by pushing it in from the side or bottom of the burner. Top fed units are well known and drop solid fuel into a burner from above.

As is known in the prior art, heat-producing systems as described herein may include various process zones in various combinations. These zones may typically be described as drying, heating, pyrolysis, combustion and reduction and exhaust.

Fuel is added to gasifiers either in a batch mode or they may embody an automated or semi-automated feed system to deliver the fuel to the burner or combuster as described herein above. As the fuel is added to the burner it is consumed by flame and the heat is typically captured by well-known heat transfer mechanisms. The by-products of the combustion of the solid fuel such as the volatile and non-volatile gases are exhausted to the atmosphere after as much as possible of the sensible heat is removed. It will be appreciated by one skilled in the art that many of the prior art systems burn the solid fuel directly and lack a controlled or selective conversion of the solid fuel to a combustible gas. As a result of prior art systems failure to provide conversion they either fail to completely burn the volatile gases produced by the flame or use excess air to completely burn the gases and dilute the energy density of the exhaust gases available for heat extraction. Both shortcomings result in lower efficiency. Also as a result of prior art systems burning the fuel directly there is a lack of control of temperature that often results in the formation of clinker from overheating the minerals (e.g. phosphorus, sodium, etc) in the fuel.

Bottom fed burners of the prior art advantageously create less entrained ash in the exhaust and less disruption to the combustion zone thereby because the fuel bed is less disturbed as the solid fuel is pushed into the burner from beneath the combustion zone. That is to say that the fuel is less disturbed by the flame by comparison to burners where fuel is supplied to the combustion zone from the top or side of the flame area wherein ash particles become entrained in the airflow. In prior art systems where the fuel is supplied by dropping it into the combustion zone from above the fuel be must heated and volatized fairly quickly as it lands in the combustion zone. This cools the combustion zone unnecessarily and causes less efficient operation.

It will be appreciated by those skilled in the art that solid fuel heating systems of the prior art suffer from such interrelated problems as fuel delivery, ash build-up and removal and clinker formation and removal. Many bottom fed systems of the prior art include the advantage of being configurable to allow ash and clinker to be pushed out of the burner on a regular basis and are therefore inherently self-cleaning. This advantage is difficult to combine with a practical means to supply the fuel to the combustion area. The feed mechanism to supply solid fuel from a bulk storage area to the combustion area must be isolated to prevent conflagration to proceed to the supply, so called back-burn. By contrast, top fed systems of the prior art typically trap clinker and ash in the burner, which must include some means of removal or they will build up and choke out the fire. Fuel supply to top fed systems of the prior art may easily accommodate automated feed systems, such as augers, because the fuel is supplied from above the combustion area the supply is inherently isolated from back-burn.

Conventional solid fuels of the prior art include wood pellets, coal, corn, wood chips and other pelletized biomass, and typically take the form of relatively small semi-uniform shapes or particles. One problem in the prior art is that fuel delivery systems, either gravity fed or certain driven systems, is that inter-particle forces between the individual pieces of fuel cause the particles to lock-up and interrupt the delivery if fuel to the combustion area. In order to avoid such problems it is advantageous to use an automated or continuous fuel delivery system or conveying means which may typically comprise an auger. However, as used in the prior art an auger has the disadvantage that the fuel conversion cannot occur along the flights of the auger since this would be both destructive to the auger and destructive to the combustion or gasification process. The auger must release control of the solid fuel before the solid fuel reaches the combustion or gasification region and therefore the auger does a poor job of controlling the delivery of the fuel relative to the oxygen sources, ash removal point and other points relevant to the combustion or gasification process. An exemplary bottom fed burner that forcibly pushes fuel into a combustion zone is disclosed U.S. Pat. No. 5,070,798 and is incorporated herein by reference in its entirety.

It will be appreciated by one skilled in the art that the lack of controlled delivery can lead to less than complete energy conversion of the fuel and add to the problems of solid and gaseous emissions. The lack of controlled delivery leads to systems of the prior art using excessive amounts of air (oxygen) to insure complete combustion. Excessive amounts of air dilutes the production gas and can lead to a loss of sensible heat in the exhaust since the sensible heat in the excess air can not be completely removed.

A recognized shortcoming of systems in the prior art is the inherent difficulty in providing for drying and preheating of the solid fuel prior to converting the fuel into producer gas through pyrolysis and reduction or combustion of the fuel to produce heat. It will be appreciated that heating and (thereby) drying a solid fuel upstream in the flow of fuel provides better control of the combustion process. This is, in part, because the volatiles in the fuel are released in a more controlled and complete way since moisture in the fuel is deleterious to the volatilization and combustion process. In the case of the bottom feed system supplied by way of an auger there is no easy path for channeling heat from the combustion area into the solid fuel in the auger. Furthermore as discussed herein above this would increase the risk of back-burn or cause clogging in the auger flights. In the case of top fed designs back-burn prevention would be circumvented since the solid fuel would have to be heated on the opposite side of the known means of back burn prevention.

What is needed in the art is a means of conveying solid fuel through the combustion or gasification process while controlling the position of each of the process zones drying, heating, pyrolysis, combustion and reduction, and not deleteriously disturbing these zones.

SUMMARY OF THE INVENTION

The present invention generally provides apparatus and methods for delivery solid particulate fuel to a heating system. In one aspect, the present invention includes a an apparatus that includes a fuel supply and a lock-up transport system wherein position of solid particles of fuel are maintained relative to one another and transported in a downstream direction in the locked-up condition. In another aspect of the invention the lock-up transport system comprises a conduit wherein a portion of the conduit translates in the downstream direction to maintain the lock-up condition of the fuel to provide for a linear mass flow of the fuel.

Further, the present invention provides in another aspect an apparatus for delivering solid particulate fuel to a heating system comprising a lock-up transport system, wherein the lock-up transport system includes at least one of a fuel heating zone, a fuel pyrolysis zone, a reduction zone and an ash removal zone. The present invention further includes a control system that monitors at least one parameter related to the performance of the heating system and controls a speed of the lock-up transport system in response to the parameter.

In yet another aspect, the present invention includes a method of delivering solid particulate fuel to a heating system that includes storing particles of fuel in a hopper and delivering the fuel to lock-up feed zone and locking-up the position of the particles of fuel relative to each other. The method further comprises maintaining the lock-up condition of the fuel while delivering the fuel to at least one of a fuel heating zone, a fuel pyrolysis zone, a reduction zone and an ash removal zone.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
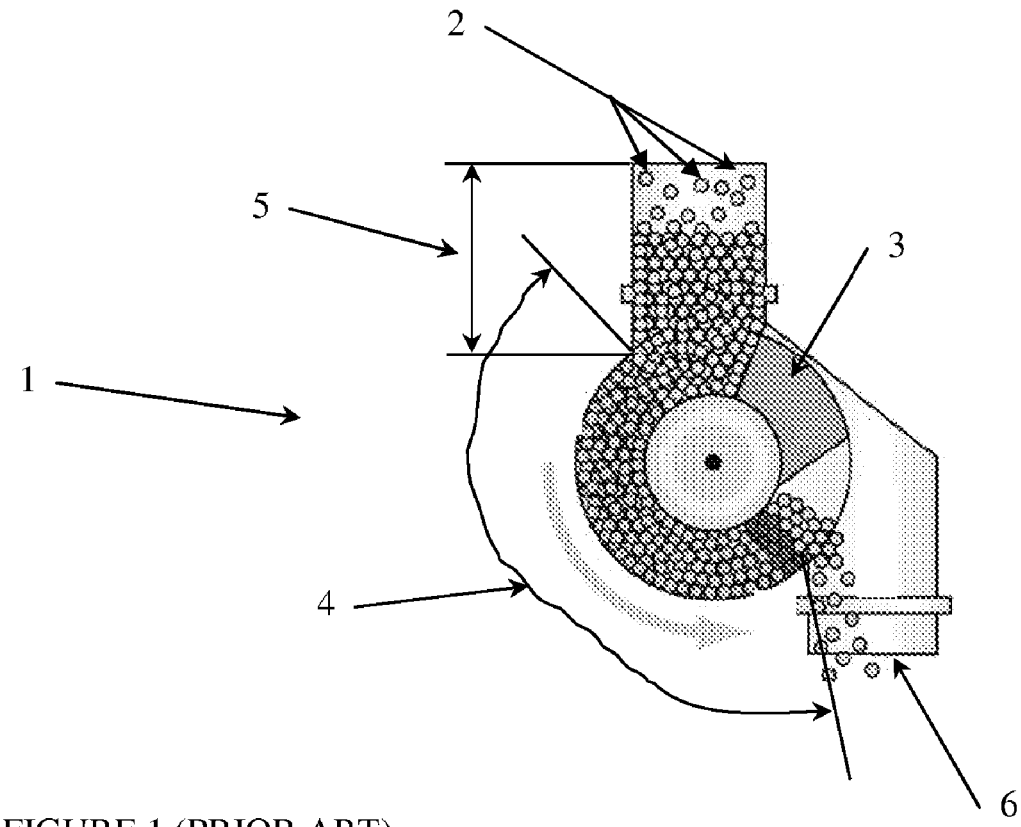
FIGURE 1 (PRIOR ART)
FIG. 1 is a side view in partial cross-section of a bulk solids pump of the prior art.

As described below, the present invention involves a solid fuel delivery and gasifier system. The solid fuel gasifier includes a unique solid fuel conveying system that allows the transport of conventional solid fuel particles into a combustion area in a controlled manner. By utilizing a controlled fuel delivery system the present invention allows for the predictable production of combustible gases through pyrolysis of the fuel prior to the system secondary combustion. Providing for this results in better control of each of the process zones and therefore a more complete conversion of the solid fuel to either producer gas or gas for immediate combustion in a close-coupled gasifier, while using an amount of air very close to the stochiometric amount. The present invention thus advantageously increases the efficiency of the combustion process, increases the amount of sensible heat output and reduces the emission of harmful solid and gaseous pollutants. Furthermore, the present invention provides for a solid fuel delivery system that utilizes heat released from the combustion and/or flaming pyrolysis zones for drying, raising the temperature, and volatizing the upstream fuel supply while avoiding back-burn.

As used herein the term "solid fuel" refers to any type of non-liquid fuel capable of producing hydrocarbons in accordance with the methods described herein. Examples of the types of solid fuels within the scope of the present invention include by way of example, wood chips, wood pellets, corn, and other pelletized biomass. In order to fully appreciate the advantages of the solid fuel gasifier of the present invention the various embodiments that follow will be described as using conventional wood pellets as the type of solid fuel by way of example only and in no way limits the invention to embodiments shown.

The fuel delivery system of the present invention uses the inter-particle forces and forces between the particles and a conduit wall to convey the particles in a downstream direction toward a combustion area. The delivery system includes a portion of the conduit that translates with the particles in a downstream direction to significantly reduce the disruption of the position of the particles relative to one another. It will be appreciated by one skilled in the art that conventional fuel delivery systems that force particles in a downstream direction result in clogging, disruption, and non-uniform delivery of the fuel. As described herein above, the inter-particle forces will cause the particles to "lock-up" inside the conduit under an applied force (such as gravity) attempting to move the particles relative to the conduit. The present invention includes any known or contemplated delivery system that takes advantage of the inter-particle forces and translates the fuel in a linear mass flow fashion. The fuel delivery system of the present invention thus takes advantage of the lock-up of the fuel particles as will be more fully described hereinbelow with reference to FIG. 1.

In FIG. 1 is shown a particle delivery system of the prior art in the form of solids pump shown generally as 1. Such a solids pump is a bulk solids pump manufactured and distributed by K-Tron Company of Pitman, N.J., USA. The pump is known for its ability to provide precise volumetric feeding of free flowing bulk materials, e.g. pellets and granules 2. The bulk solids pump feeder has a rotating disc 3 that creates a product lock-up zone 4 conveying the material smoothly from storage hopper (not shown) located above a consolidation zone 5 to outlet 6. True, linear mass flow of particles is achieved. This principle is referred to herein as lock-up transport.

Figure 2:
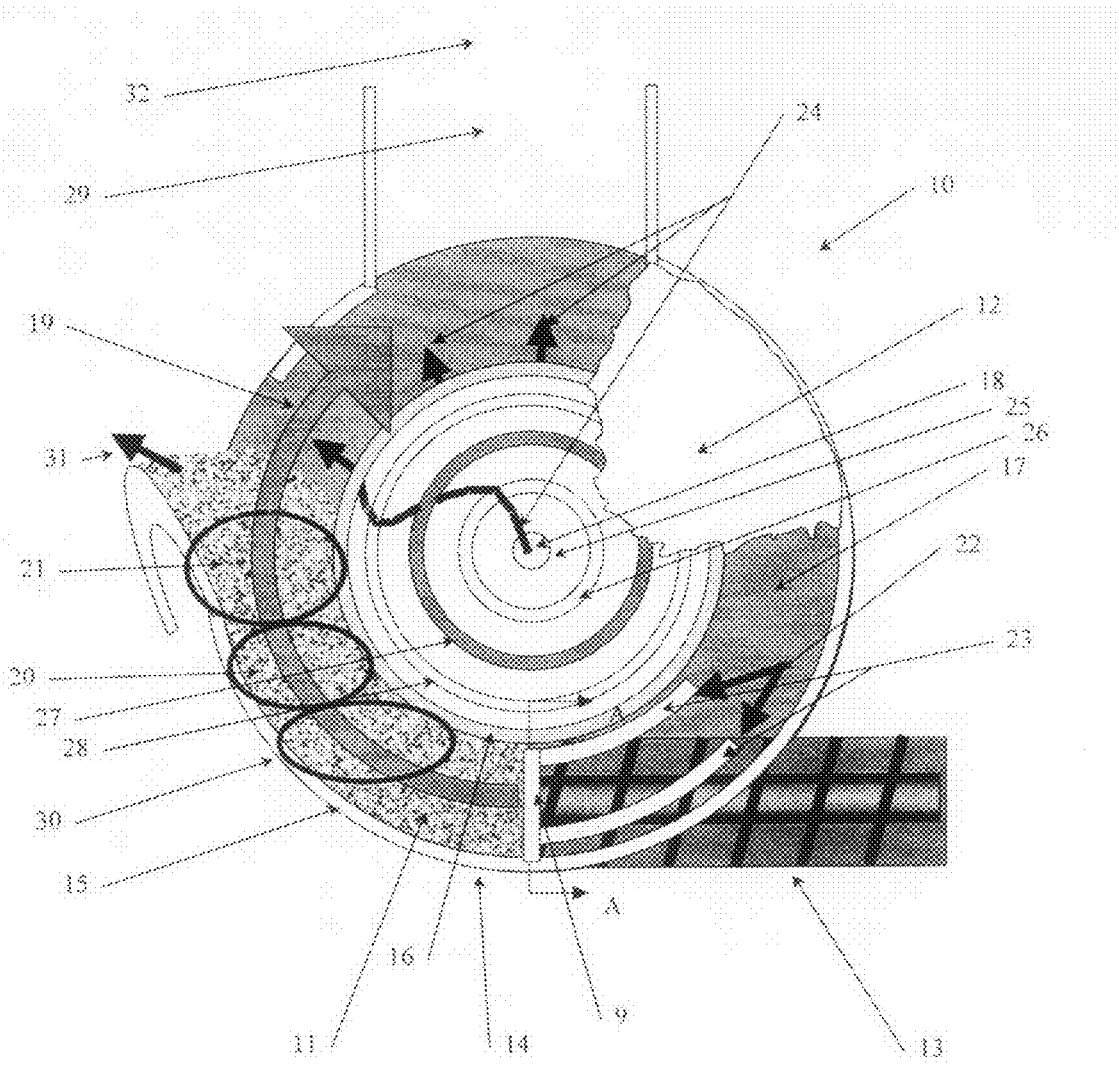
FIG. 2 is a side view in partial cross-section of an exemplary solid fuel gasifier in accordance with the present invention.

FIG. 2 shows an exemplary solid fuel gasifier 10 for the supply of solid fuel 11 and its further gasification and combustion. The current invention thus discloses the use of inter-particle forces to lock the individual pieces of solid fuel together (relative to each other) and move it through the gasification or combustion process in a constant mass flow. The solid fuel gasifier in the figure is shown in partial section with a part of front portion 12 removed to show the arrangement and cooperation of the various components. As is shown in the figure solid fuel particles 11 are conveyed from a supply hopper (not shown) by way of an auger 13 into fuel feeding zone 14 of the solid fuel gasifier. The area within the fuel feeding zone comprises a chamber resembling a partial toroid defined by the supply end 9 of the auger 12, outer annular shell 15, inner annular shell 16, front portion 12, and back plate 17 and is collectively referred to herein as fuel feed zone or system or spool. It should be appreciated that auger 13 could instead be a chute that is gravity fed by advantageously positioning the chute at a different position relative to the fuel heating zone 30 as will be discussed in more detailed hereinafter with reference to FIG. 4. In this particular embodiment back plate 17 rotates about center 18 in the downstream direction represented by the direction of pyrolysis gases and arrow 19. Front plate 12, outer annular shell 15, and inner annular shell 16, may also rotate, either individually or in combination, in a similar fashion to facilitate the linear mass flow of fuel 11. In operation, solid fuel 11 is locked-up within fuel feeding zone 14 and is transported downstream 19 in a linear mass flow by rotation of back plate 17. The speed of the auger may be overdriven relative to the rotational speed of the spool to maintain a lock-up condition of the fuel. The back plate or front plate or inner core could be dimpled or otherwise show a raised surface to better engage the fuel when it is in a state of lock-up. It should be appreciated that the walls may be shaped to provide a choke condition in the downstream direction to maintain a state of lock-up of the fuel in the upstream direction. The fuel 11 is ignited by any known means near or above pyrolysis zone 20, and upon pyrolysis forms a layer of charcoal thereupon in reduction zone 21. Primary air 22 for pyrolytic gasification enters fuel-feeding zone 14 through conduits 23 and travels a circuitous path through the un-burned, locked-up fuel 11 to pyrolysis zone 20. At pyrolysis zone 20 the primary air provides oxygen for sustaining sub-stoichiometric combustion. The heat released from this combustion heats the surrounding fuel to form wood gases or pyrolysis gases 19 made up of, for example, hydrogen, carbon monoxide, methane, carbon dioxide, some higher hydro carbons, water vapor, nitrogen and other gasses as is known depending on the type of solid fuel and other factors pf pyrolysis or other volatile gas in the flaming pyrolysis zone. Although not shown, primary air 22 may be introduced into conduits 23 through any known means such as compressed air or simply a conduit at negative pressure relative to atmosphere. The flow of primary air 22 may also be reversed to that indicated by the arrows and drawn by a negative pressure applied to conduits 23. This arrangement has the advantage of preheating the primary air and the depleted smoke filled air may be exhausted with the flue gasses as described herein below.

Figure 3:
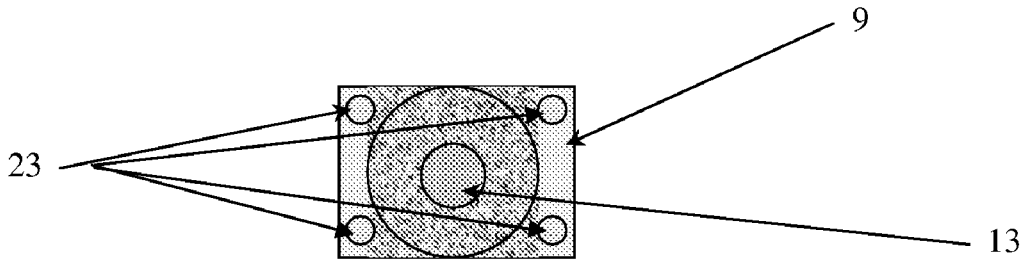
FIG. 3 is a cross-sectional end view of an auger feed and primary air conduits taken substantially along line A-A of FIG. 1 in accordance with the present invention.

Referring to FIG. 3 there is shown the end of auger 13 and primary air conduits 23. In this particular embodiment this illustrates the point at which primary air enters the fuel supply area.

Volatile pyrolysis gases 19 produced in the pyrolysis zone 20 are swept downstream into the reduction (or char) zone 21 where they are reduced and the char is consumed. Secondary air represented by arrow 24, is injected downstream of reduction zone 21. Secondary air 24 may be introduced through a conduit 25 by any known means and travel through a series of shells (or baffles) 26, 27, 28, and inner shell 16 before being introduced above reduction zone 21. The shells or baffles may advantageously create a convoluted path as represented by the path of arrow 24 in which heat is transferred from the pyrolysis zone or the secondary combustion zone 29 to the secondary air 24 to preheat the air prior to being introduced into secondary combustion chamber 29. The preheated secondary air 24 supports secondary combustion in zone 29 of the gases produced in fuel preheat zone 30, pyrolysis zone 20 and reduction zone 21. It should be appreciated that preheating the secondary air 24 raises the efficiency in the conversion process.

It will be appreciated by those skilled in the art that heat produced in the pyrolysis zone is conducted to the fuel 11 in the fuel preheat zone 30. The preheating of the fuel accomplishes the driving off of any moisture in the fuel and begins the gasification of the fuel ahead of flaming pyrolysis thereby increasing the efficiency of the flaming pyrolysis process. The controlled linear mass flow delivery of fuel 11 from auger 13 downstream towards reduction zone 21 provides for the processes of drying, pyrolysis, reduction and secondary combustion while preventing back-burn into the fuel delivery system.

The heating system 10 of the present invention relies on a controlled coordination between the amount of pyrolysis gas 19 formed in the pyrolysis zone 20 and the amount of secondary air 24 used to consume these gases. An increase in primary air 22 creates more heat in the pyrolysis zone and therefore more gases 19 which then requires more secondary air 24 to consume these gases. Also, the position of the pyrolysis zone 20, controlled by the lock-up transport rate relative to heat being produced, will expose more or less unconverted fuel 11 to the pyrolysis zone, resulting in the production of more or less gases 19 being produced as a function of time.

In appreciating the effect that controlled delivery of solid fuel has on the function of the present invention requires some discussion of the chemistry of gasification. For instance, sub-stoichiometric combustion of fuel 11 with oxidant produces hydrogen, carbon monoxide, methane, carbon dioxide, some higher hydrocarbons, water vapor and nitrogen in proportions depending on the fuel and air source (oxidant) used. A typical wood pelletized fuel (Biomass) combined with air may be represented by the following relation in Equation 1:

$$\text{Biomass}+\text{Air}=20\pm2\%\ H_2,\ 20\pm2\%\ CO,\ 2\%\ CH_4,\ 12\pm2\%\ CO_2,\ 8\pm2\%\ H_2O,\ \text{rest}\ N_2 \qquad \text{Equation 1}$$

The reactions that take place in the heating system 10 of the present invention are shown in the following table (Table 1). Partial oxidation of the biomass fuel 11 by primary air or oxygen 22, takes place in the flaming pyrolysis zone 20. By flaming pyrolysis it is meant herein that there is a coexistence of oxidation of some of the carbon (flaming) and the devolitilization of the fuel around it in a sub-stoichiometric, oxygen starved zone. This oxidation gives off the heat required to devolitize the fuel. Devolatilization results in the formation of char and gaseous products (CO, $CO_2$, $H_2$ and condensable hydrocarbons ). The other reactions, steam-carbon, reverse Boudouard, water gas shift and to a limited extent the hydrogasification and methanation reactions take place in the reduction zone 21. The result of the above reactions is a gas consisting of various amounts of CO, $H_2$, $N_2$, $CO_2$, steam and hydrocarbons. The products of combustion, $CO_2$ and $H_2O$ pass through a reduction zone 21, which is comprised of hot char, to convert $CO_2$ and $H_2O$ into CO and $H_2$ and in part, $CH_4$. The net effect is a reduction in the amount of air consumed.

TABLE 1

| REACTIONS | | Enthalpy of Reaction (kj/mol) |
|---|---|---|
| Devolatilization C + Heat | $CH_4$ + Condensable hydrocarbons + char | |
| Steam – Carbon C + $H_2O$ + Heat | CO + $H_2$ | 131.4 |
| Reverse Boudard C + $CO_2$ + Heat | 2CO | 72.6 |
| Oxidation C + $O_2$ | $CO_2$ + Heat | (−)393.8 |
| Hydro-gasification C + $2H_2$ | $CH_4$ + Heat | (−)74.9 |
| Water gas shift $H_2O$ + CO | $CO_2$ + $H_2$ + Heat | (−)41.2 |
| Methanation $3H_2$ + CO | $CH_4$ + $H_2O$ + Heat | (−)206.3 |
| $4H_2$ + $CO_2$ | $CH_4$ + $2H_2O$ + Heat | (−)165.1 |

It is contemplated by the present invention to monitor a parameter related to the performance of the heating system and to control the delivery of fuel thereby to optimize the overall heating system performance. For instance the monitoring exhaust gas 32, by any known means, for CO, $O_2$ and temperature provides information as to how the system is performing relative to the stochiometric ratio. A perfect stochiometric combustion would be one where the $O_2$ and CO are both zero. For instance, if the lock-up transport of fuel 11 into pyrolysis zone 20 was too fast the exhaust gases 32 would contain an excess of CO, i.e. all of the available $O_2$ in the secondary air 24 would be consumed and the system would be running too rich. By contrast, if the lock-up transport of fuel 11 into pyrolysis zone 20 was too slow smaller amounts of co would be produced in the pyrolysis zone and the exhaust gases 32 would contain an excess of $O_2$ and the system would be running too lean. It may also be the case that there is the addition of too much secondary air 24 and thusly too much $O_2$. At stochiometric combustion you have minimized the dilution of the sensible heat and optimized the overall performance of the system. It should also be appreciated that thermostatic control of the performance of the heating system may be achieved by monitoring the temperature of one or several locations.

In operation, while monitoring exhaust gases 32 if the measured amount of $O_2$ is more than 10%, the balance of the primary air and/or fuel feed rate may be adjusted to bring the system toward the stochiometric ratio. For instance, the rate of primary air 22 and/or the feed rate of fuel 11 would be increased. These actions would produce pyrolysis gas 19 and consume some of the excess secondary air 24. If on the other hand the measured amount of CO in exhaust 32 rises above around 20 or 30 ppm the amount of secondary air 24 would be increased and/or the fuel feed rate would be reduced. It will be appreciated that the rate of delivery of secondary air 24 may be increased or decreased to produce a decrease or increase in the measured amount of CO, or to produce an increase or decrease the combustion temperature. It will be further appreciated that the monitoring functions and the adjustment of air and fuel rates may be accomplished by known electronic, mechanized, optic or other methods and may further be controlled in closed loop fashion.

The present invention further has the advantage of being virtually self-cleaning in that the linear movement of the fuel by the rotation of the back plate 17 carries the fuel 11 through reduction zone 21 to ash dump zone 31 wherein ash 32 may be expelled from the system by being pushed out an opening or through a grate (not shown). Of course the arrangement of the ash dump zone 31, or any of the described zones, may be position at various rotational positions to best suit any particular arrangement.

Figure 4:
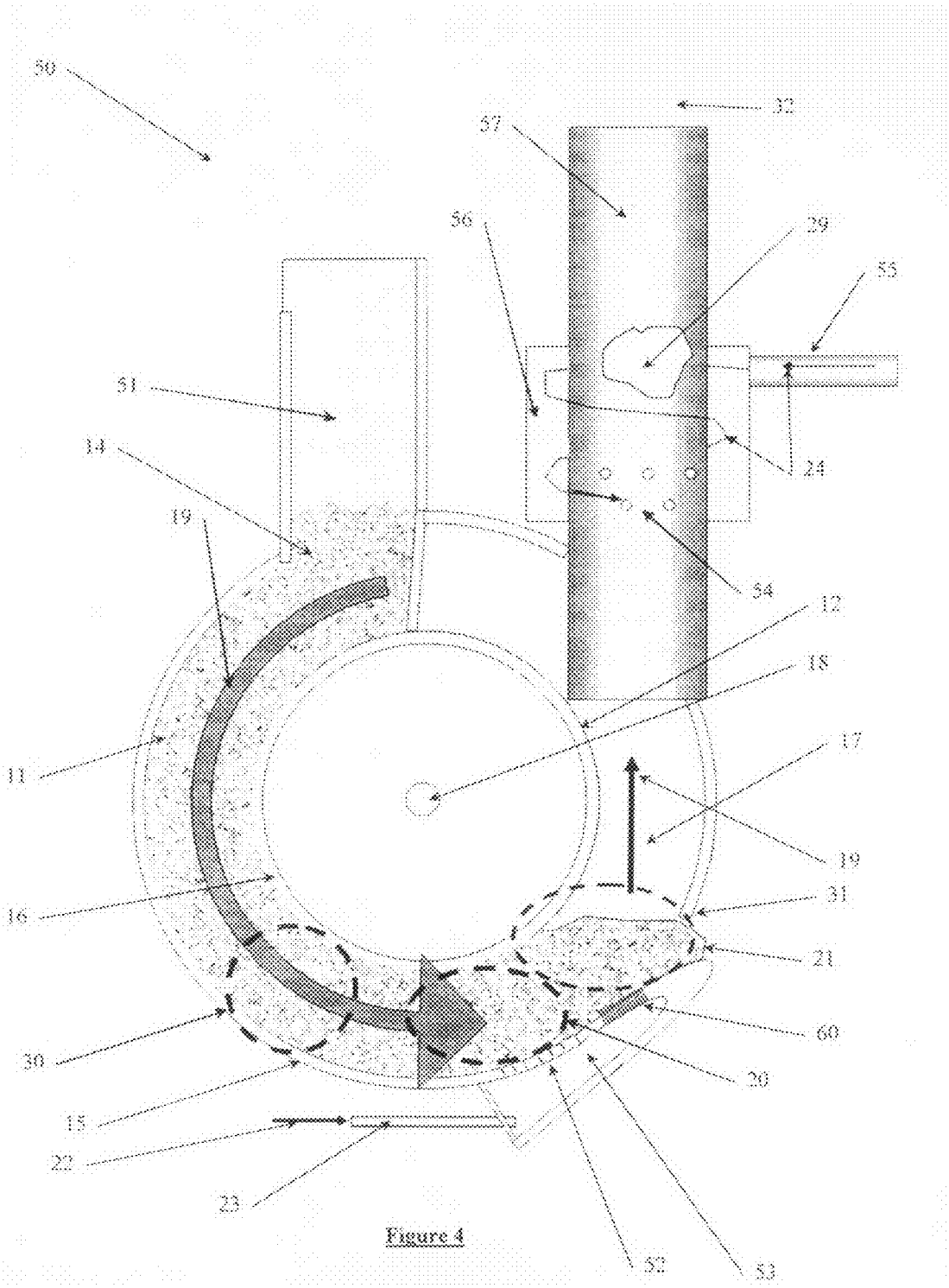
FIG. 4 is a side view in partial cross-section of an exemplary solid fuel gasifier in accordance with the present invention.

Referring to FIG. 4 there is shown an exemplary embodiment of a heating system 50 in accordance with the present invention that features a spool type lock-up fuel transport mechanism wherein the front flange of the spool has been removed. This embodiment is similar to that described herein above and similar features are similarly numbered. In this particular embodiment solid fuel 11 enters the fuel feed zone 14 through fuel chute 51 that may be further connected to a hopper or similar supply mechanism (not shown). Supply chute 51 is shown positioned in a substantially vertical position and takes advantage of gravity to provide fuel 11 into fuel feed zone 14 in a lock-up condition. In other words, the weight of the fuel 11 above the spool causes the fuel within the spool flanges to "lock-up" and move in a linear mass flow in the direction of rotation of the spool, or in the downstream direction as represented by arrow 19. Primary air 22 is introduced into pyrolysis zone 20 through conduit 23 via holes 52 in plenum 53, or at any number of positions upstream in the fuel flow including into chute 51. As described hereinabove the process of drying fuel 11 occurs in fuel heating zone 30, pyrolysis occurs in pyrolysis zone 20, and primary combustion and reduction occurs in char zone 21. Since these processes all occur within the controlled lock-up transport mechanism of the present invention, i.e. the conveying means of the spool, there exists the means to control the position of these processes relative to the primary air injection 52 and ash disposal 31 points ash can also be disposed of through a grate 60. The clocking of the zones can be rotated +/− from that shown in the embodiment without deviating from the present invention.

Referring still to FIG. 4 secondary pyrolysis gases 19 as described herein above enter combustion area 29 in the downstream direction. Secondary air 24 enters combustion area 29 through a plurality of combuster holes 54. In this particular embodiment secondary air 24 enters through conduit 55 into combuster annulus 56 about exhaust stack 57. The secondary air enters the annulus 56 and travels about the hot exhaust stack 57 thereby preheating secondary air 24. The preheated secondary air 24 enters combustion area 29 in a circular flow pattern tangential to the walls of exhaust stack 57 to provide a quick and even mixing with pyrolysis gases 19, as well as to increase residence time of the air with the gases in the hot combustion zone, prior to combustion. Combustion may be initiated by any know source (not shown) and may be manually or automatically controlled as is known in the art. Post combustion gases exist the system 50 in exhaust area 32.

Although it is not shown, it will be appreciated that the embodiments described herein benefit from the practical placement of insulating materials to reduce heat loss to the ambient environment. The amount, type and placement of insulating materials is a matter of engineering choice and will vary depending on the exact combinations of features described herein above.

Figure 5:
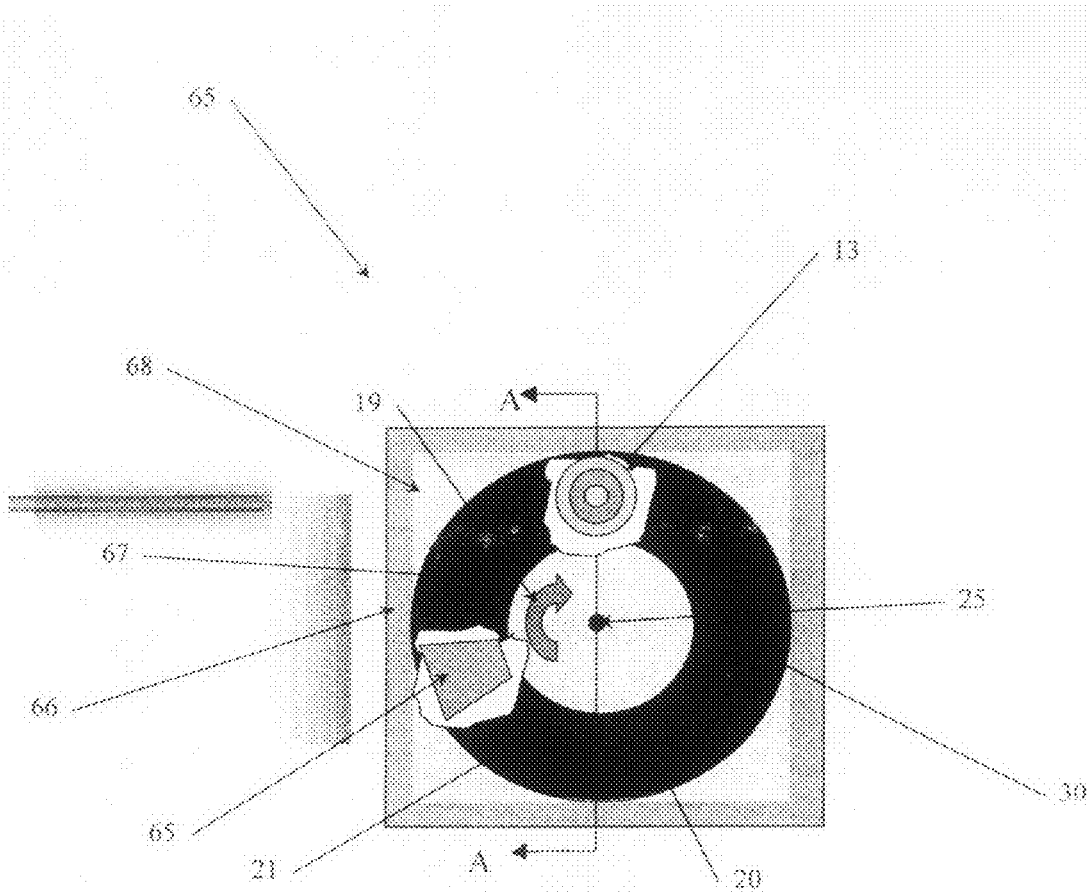
FIG. 5 is a side view in partial cross-section of an exemplary solid fuel gasifier including a half-toroid lock-up transport system in accordance with the present invention.
Figure 6:
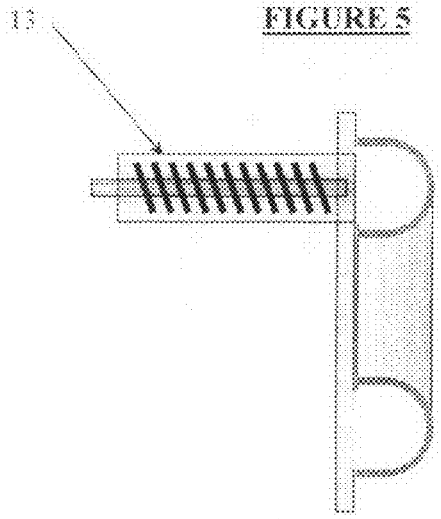
FIG. 6 is a cross-sectional view taken substantially along line A-A of FIG. 5 showing they auger and half-toroid in accordance with the present invention.

Referring now to FIGS. 5 and 6 there is shown a heating system 65 of the present invention wherein the fuel lock-up transport system 66 comprises a half-toroid shell 67 coupled to a back plate 68. Fuel is fed into the transport system via auger 13 through an opening in back plate 68 and becomes locked-up within shell 67. Shell 67 rotates about center 25 in the downstream direction 19 transporting the fuel in a lock-up condition through fuel heating zone 30, pyrolysis zone 20 and reduction zone 21. This embodiment further includes an ash dump port 69 positioned downstream of reduction zone 21 and gas flue 70 that conducts volatile gasses to a secondary combustion zone (not shown) similar to that discussed herein above.

While the foregoing is directed to embodiments of the present invention, other and further embodiments of the invention may be devised without departing from the basic scope thereof, and the scope thereof is determined by the claims that follow.

The invention claimed is:

1. An apparatus for producing heat from a solid fuel having a gasifier, the apparatus comprising:

a fuel delivery supply;

a fuel lock-up transport system positioned to receive fuel from the fuel delivery supply, the fuel lock-up transport system having a downstream flow direction, a fuel feed section, a fuel lock-up section for placing the fuel in a lock-up condition, a fuel delivery section wherein a portion of the fuel delivery section comprises a conduit and maintains a lock-up condition of the fuel and further provides for a linear mass flow of the fuel in the downstream direction;

wherein at least a portion of the conduit is moveable in the downstream direction to provide for the linear mass flow of the fuel;

wherein the conduit comprises a spool section and wherein the spool section comprises:

an inner annular wall;

an outer annular wall spaced apart from and positioned substantially concentric to the inner annual wall;

a front wall positioned on a front end of both the inner and outer annular walls; and a back wall positioned on a back end of both the inner and outer annular walls; and wherein any of the inner annular wall, outer annular wall, front wall or back wall rotate about the center of the inner annular wall in the downstream direction; and a fuel heating zone within the fuel delivery section;

a fuel pyrolysis zone positioned downstream of the fuel heating zone; and a reduction zone positioned downstream of the fuel pyrolysis zone.

2. The apparatus of claim 1 further comprising a motor to rotate any of the walls.

3. The apparatus of claim 1, wherein the conduit is positioned in a substantially vertical position providing fuel to the fuel lock-up section in the downstream direction.

4. The apparatus of claim 1, wherein the conduit comprises a toroidal front section and a back wall positioned against a back face of the toroidal section wherein any of the toroidal section of the back wall rotate in the downstream direction about the center of the toroid.

* * * * *